US005762561A

United States Patent [19]

Zine

[11] Patent Number: 5,762,561

[45] Date of Patent: Jun. 9, 1998

[54] CUSTOM GOLF SCORECARD DESIGN AUTOMATION

[75] Inventor: David M. Zine, Vancouver, Wash.

[73] Assignee: Electric Scorecards, Inc., Billings, Mont.

[21] Appl. No.: 741,873

[22] Filed: Oct. 30, 1996

[51] Int. Cl.[6] ..... G06F 161/00

[52] U.S. Cl. ..... 473/131

[58] Field of Search ..... 473/131, 407, 473/409; 364/410, 411, 412; 340/323 R; 273/460, DIG. 26

[56] References Cited

U.S. PATENT DOCUMENTS 4,367,526 1/1983 McGeary et al. ..... 377/5

5,536,010 7/1996 Lambourne ..... 364/411

*Primary Examiner*—George Manuel

*Attorney, Agent, or Firm*—Marger, Johnson, McCollom & Stolowitz, PC

[57] ABSTRACT

The system for creating a custom golf scorecard comprises a computer interface for receiving a user selection of one of a predetermined plurality of scorecard designs and user input textual data. The design selection, the textual data and a file name to identify the user together form a preliminary digital scorecard specification. The system includes a memory or storage device having a set of image placeholders and associated representative images which can be assigned to certain panels of the user's custom designed golf scorecard. Exemplary representative images include a digital image of a selected portion of a generic golf course, a generic graphical logo, a generic photograph, or a generic computer generated map of a golf course. A complete digital scorecard specification is generated via a computer which integrates together image placeholders and associated representative images selected from the storage device, the design selected by the user, and the textual data input by the user. The virtual card can then be graphically displayed, as on a computer screen, to graphically represent a custom golf scorecard responsive to the complete digital scorecard specification.

20 Claims, 9 Drawing Sheets

CUSTOM GOLF SCORECARD DESIGN AUTOMATION

BACKGROUND OF THE INVENTION

This invention relates generally to graphic computer design tools and more particularly to a method and apparatus for custom designing golf score cards.

Modern golf scorecards come in many shapes and sizes. One variable which a golf shop might desire is a bi-fold card in which preprinted information such as hole number, par, yardage and handicap numbers are arranged within rows of a scoring grid on the inside of the card and art work representative of the golf course is printed on the outside. Other card configurations are the off-center bi-fold, the tri-fold, and other arrangements shown in FIG. 3. Another variable to the score card is the color scheme used. Often, it is desired to print the rows containing the preprinted information with a particular color to distinguish it from the rows used for scoring. Still another variable would be whether to show an image of the golf hole above the column containing the numeric data for each hole. These variables are in no way exclusive and are meant only to show the many decisions which need to be made in order to customize a golf scorecard to a particular golf course.

Prior art design and printing techniques and devices for such changeable objects as checks and golf score cards are primarily manual operations. In the case of score cards, a conventional multicolor master is assembled from multiple monochrome negatives, each representing one of the basic printing colors: cyan, magenta, yellow and black (CMYK). A printing negative, showing the intensity of each of these colors at a particular location on the card, must be made for each of the four CMYK colors in order to print a full spectrum color card. The process for doing this required cutting and pasting the negatives of photographs or art work to carefully placed locations on the master negatives, carefully centering the preprinted information within the grid work, and other labor intensive steps which makes the process both expensive and inaccessible to the amateur. Consequently, a golf course would work with a graphic artist to design the card by hand and print an enormous number of score cards to save on later redesign costs.

Problems occur, however, when golf courses undergo repair of a certain portion of the course or remodeling which changes the yardage of certain holes. Because redesigning the scorecard is an expensive and time consuming process, even by just changing certain yardage values within the scoring grid, most golf courses often elect to not print updated cards, especially when the change is temporary. Thus, the new information is not communicated to the golfer via the score card which may have been designed and printed many years earlier.

Accordingly, a need remains for an method and apparatus for simplifying the design process for score cards and other like items to overcome the disadvantages over the prior art.

SUMMARY OF THE INVENTION

It is, therefore, an object of the invention to enable an end user such as a golf shop to easily generate a virtual golf score card via a computer.

Another object of the invention is to provide a multitude of design criteria selectable by an end user which can be implemented to create an original golf score card.

The system for creating a custom golf scorecard comprises a computer input means for receiving a user selection of one of a predetermined plurality of scorecard designs and user input textual data. The design selection, the textual data and a file name to identify the user together form a preliminary digital scorecard specification. The system includes memory or storage means such as a hard disk drive having a user library of digital images which are representative of the user's golf course. Exemplary representative images include a graphical logo, scanned photographs, or a computer generated map of a golf course. Computer means form a complete digital scorecard specification which integrate together an image selected from a representative library, the design selected by the user, and the textual data input by the user. The virtual card can then be graphically displayed, as on a computer screen, to graphically represent a custom golf scorecard responsive to the complete digital scorecard specification.

The method of electronically configuring the golf score card includes storing a plurality of images as described above in a representative digital library. The user then selects a card format and card layout to define panels and grids within the card which can contain user selected images and textual data. For example, the front of the card can contain a selected picture of the golf clubhouse while the interior or backside of the card can contain a scoring grid describing the hole number, yardage, par, handicap and tee type and includes blank grid elements in which the golfer can record scoring information relating to a particular round of golf. The grid layout, having a user defined number of rows and columns, is assigned to at least one of the panels. Additionally, an image from the library is assigned to a selected one of the panels and the entire virtual card is graphically represented and arranged according to the user selected criteria. The resulting specification can then be downloaded onto a floppy disk or transmitted via electronic means to a design facility for professional printing of the number of cards desired, thus enabling a user to have full design control over the appearance and arrangement of the score card according to the specifications selected.

The foregoing and other objects, features and advantages of the invention will become more readily apparent from the following detailed description of a preferred embodiment of the invention which proceeds with reference to the accompanying drawings.

DETAILED DESCRIPTION

Figure 1:
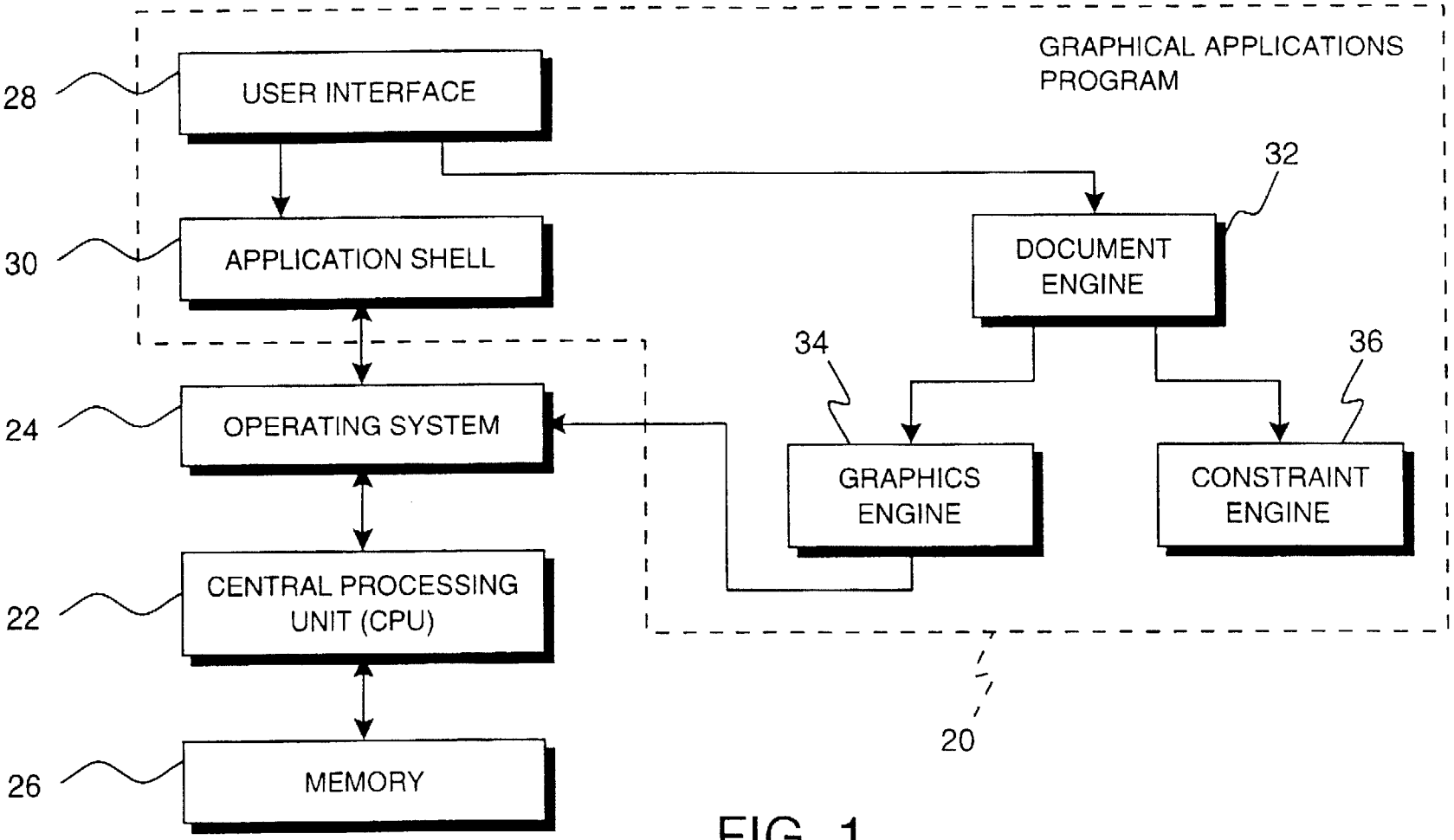
FIG. 1 is a block diagram of a graphical applications program formed in accordance with the invention.

A graphical applications program 20 for specifying alignment and distribution criteria between graphical elements is shown generally in FIG. 1. The graphical applications program 20 runs on a central processing unit (CPU) 22 controlled by an operating system 24. A memory 26 is connected to the CPU and generally comprises, for example, random access memory (RAM), read only memory (ROM), and magnetic storage media such as a hard drive, floppy disk, or magnetic tape. The CPU 22 may be housed within a personal computer, minicomputer, or a mainframe (with one or more users), as the benefits and functionality of the graphical applications program 20 may be implemented on a number of types of computers. In order to avoid unduly complicating this description, reference in the specification and drawings is generally made to personal computers and their operating systems. In this regard, a graphical applications program formed in accordance with this invention may, for example, run on Macintosh®, International Business Machine (IBM®) and IBM® compatible personal computers. When used with IBM® compatible personal computers, the operating system 24 may utilize a windowing environment such as Microsoft Windows®.

The graphical applications program 20 includes a user interface 28 that interacts with the operating system 24 through an application shell 30 to form a computer input means. Coupled between the user interface 28 and operating system 24 are a document engine 32, a graphics engine 34 and a constraint engine 36. Software program "engines" are generally defined as the portions of a program that determine how the program manages and manipulates data. The document engine 32 manages a display list that contains a list of all of the graphical elements in a document. In addition, the document engine 34 saves and continually updates an element database that includes a set of "values" for each graphical element. The values of a graphical element determines attributes such as its shape, size, color, etc. Throughout the specification and in the claims, the term "graphical element" is used to generally refer to display objects and other objects, for example, nonprinting objects, which may be manipulated by the graphical applications program. The graphics engine 34 utilizes the values stored within the element database of the document engine to render or display the graphical elements on a cathode-ray tube or other output device. Because the document engine 32 and graphics engine 34 can be implemented using technology that is generally known to those skilled in the art, the details of these engines are not described here.

Figure 2:
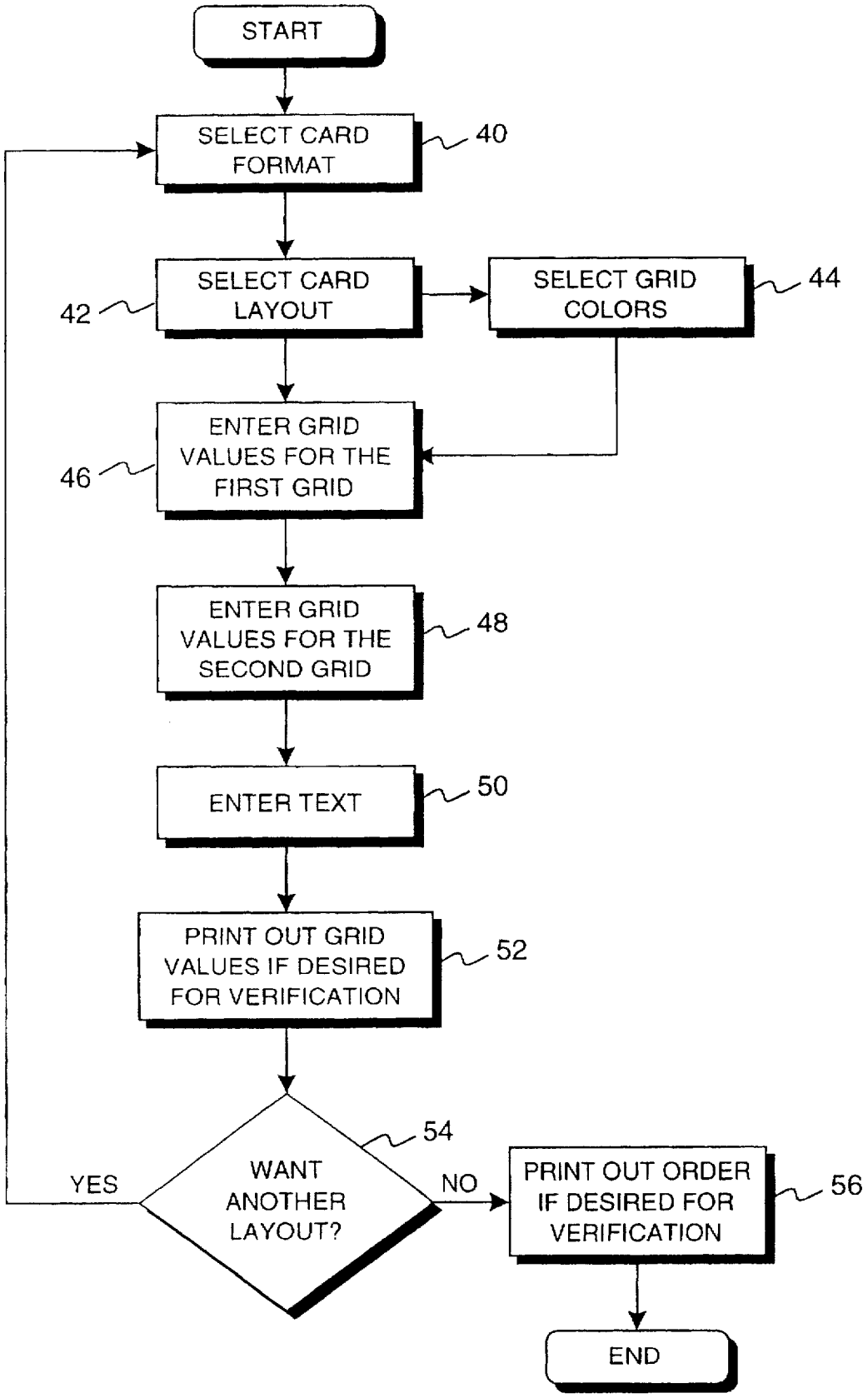
FIG. 2 is a flow diagram illustrating the method for carrying out the invention.
Figure 3:
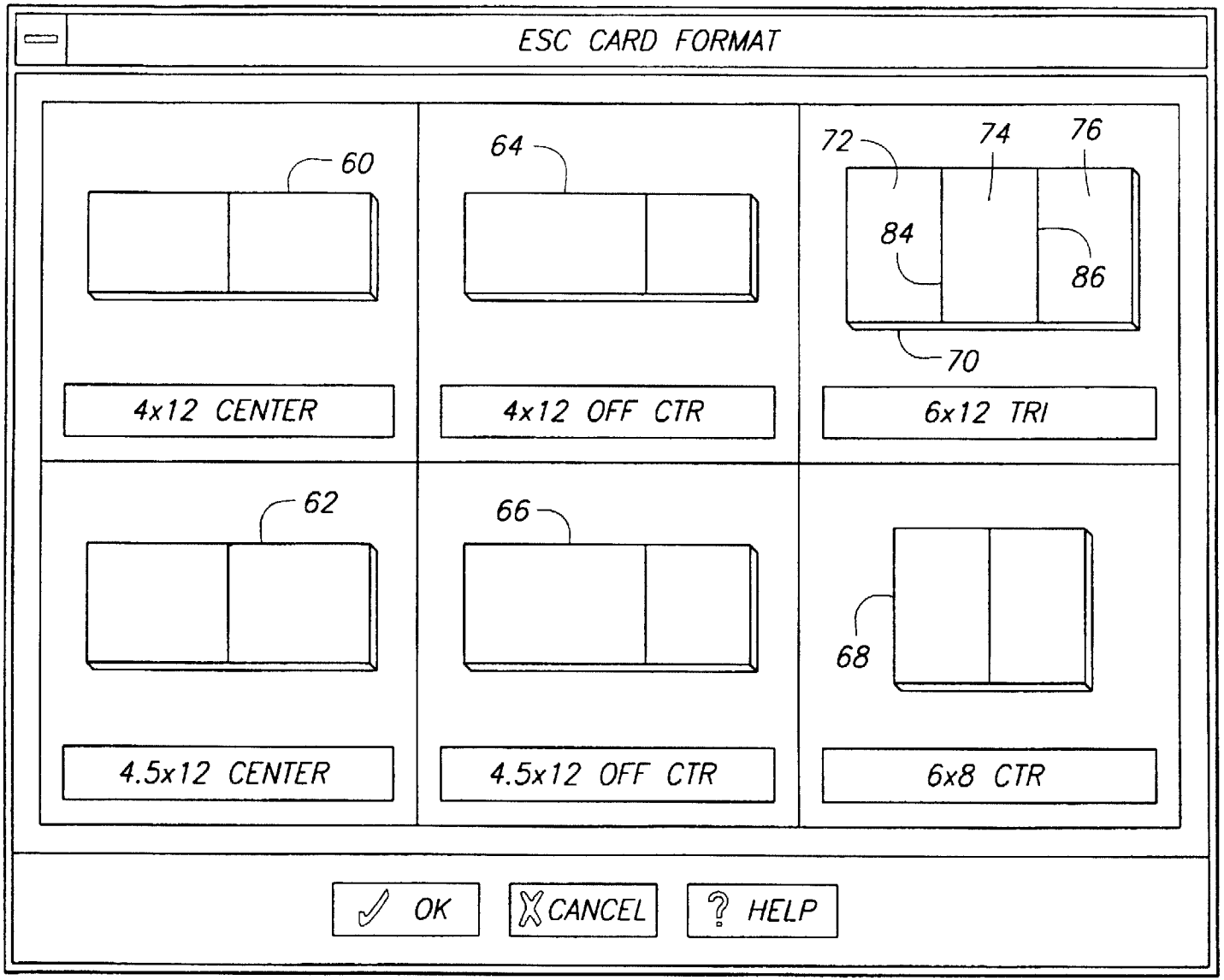
FIG. 3 is a pictorial representation of a computer display screen user interface illustrating exemplary scorecard configurations which may be selected in accordance with the invention.

FIG. 2 shows the process steps for forming a virtual golf scorecard in accordance with the computer input means. Upon initiating the graphical applications program 20, the user is presented with a plurality of predetermined golf card formats shown generally in FIG. 3. FIG. 3 shows six typical card formats including landscape centered bi-folds 60,62, off-center bi-folds 64,66, portrait centered bi-fold 68 and tri-fold 70. Each of the above-described card formats divides the virtual golf score card into a specified number and arrangement of panels. Referring specifically to the later format, tri-fold format 70 includes a front side having three front panels 72,74,76 and a backside having three back panels 78,80,82 (shown with reference to FIG. 5) separated along two folds 84,86. The user selects the card format in step 40 from the plurality of predetermined formats, as by positioning a cursor over the image via an input device such as a mouse and clicking thereon, to thereby divide the virtual golf score card into panels which can be manipulated as further described below.

Figure 4:
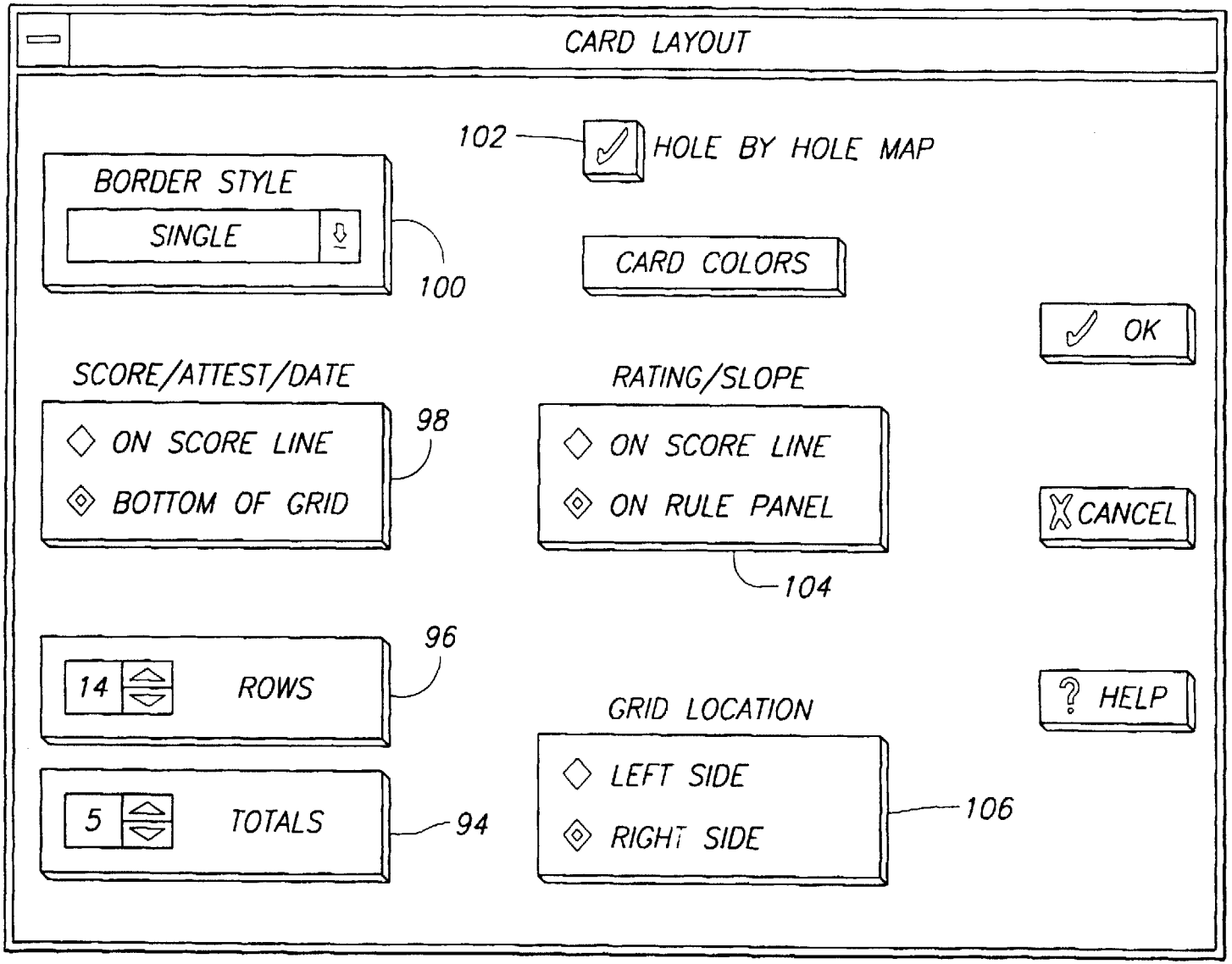
FIG. 4 is a pictorial representation of a computer display screen user interface illustrating exemplary scorecard layout criteria which may be selected in accordance with the invention.

Once the card format has been selected, the computer presents card layout options, e.g. the screen display of FIG. 4, and a user selects the card layout in step 42. FIG. 4 illustrates a user interface screen for specifying the plurality of criteria necessary to determine the layout of the card. The card layout includes such criteria as the construction, placement and sizing of a user defined scoring grid on the card. The scoring grid is capable of displaying information about the golf holes, such as yardage, par and handicap, and includes blank portions therein, such as grid elements 87 and 89, which the golfer fills in to denote the player and score on each hole. The user-defined grid can be constructed by inputting or selecting a number of rows and columns from boxes 94,96 which thereby define a grid layout having a plurality of grid elements, such as elements 88,90,92 shown in FIG. 7. In the preferred embodiment shown, box 94 allows a user to select the number of additional columns on the scoring grid beyond those used to contain data about the eighteen golf holes. Thus for instance, a selection of five as shown yields score columns for OUT and IN (total score over the first and last nine holes respectively), TOT (total score from eighteen holes), HCP (golfer's handicap over eighteen holes), NET (total score minus the handicap) and a blank space used, for example, to receive a ranking number. Other criteria of the card layout which can be selected include, but are not limited to, the border style 98, the golfer's signature line for attesting to the accuracy of the golfer's score at 100, whether to include a hole by hole map above the grid at 102, the location where the golf course rating is to be displayed on the virtual card at 104, and the grid location 106.

Figure 5:
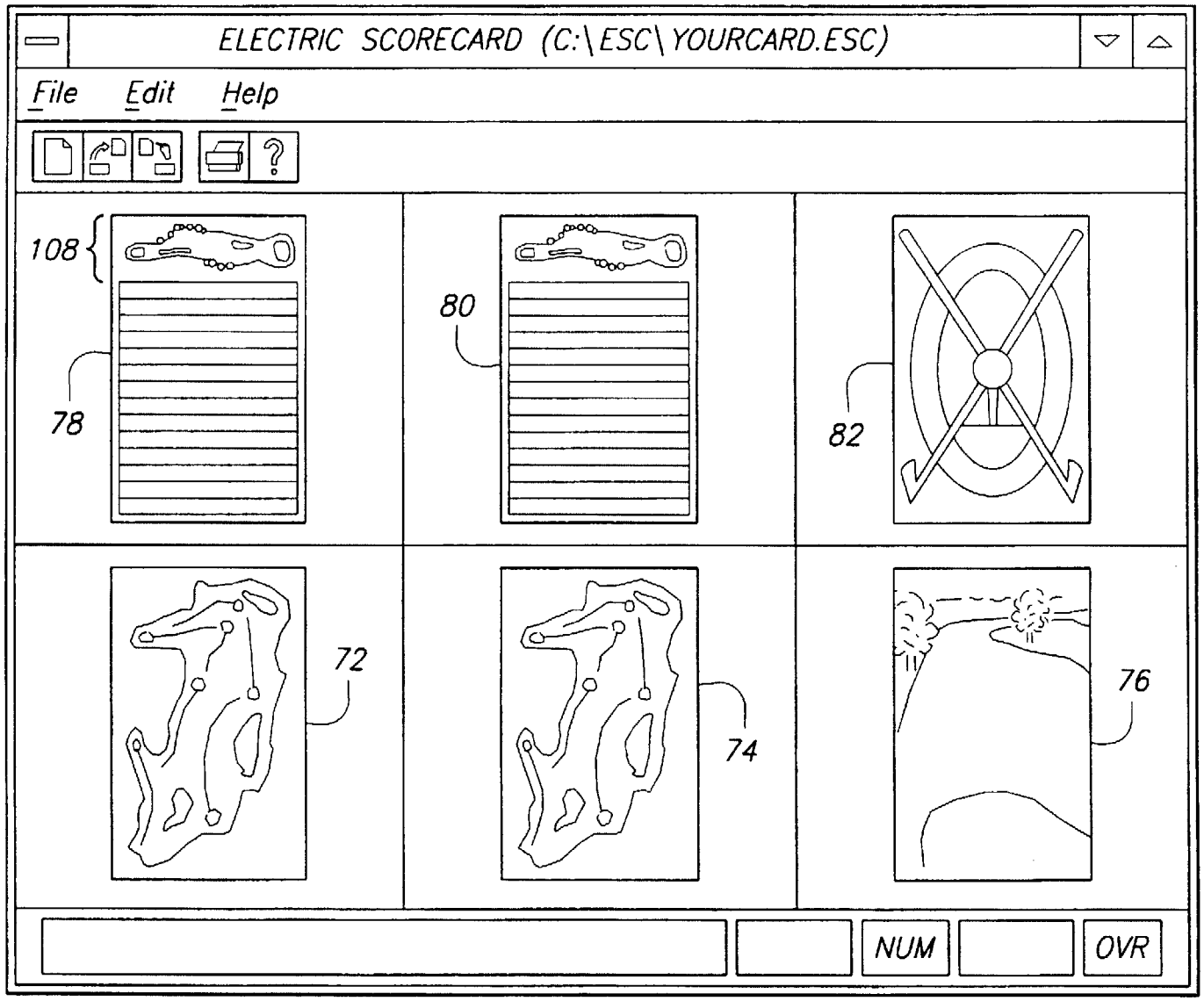
FIG. 5 illustrates a thumbnail representation of a score card created using the selected criteria shown in FIG. 4.

FIG. 5 shows an illustrative representation of the tri-fold virtual score card in accordance with the criteria shown selected in FIG. 4 and selected in steps 40,42. The tri-fold panel card format shown includes left, center and right front panels 72,74,76 having respective inside or back panels 78,80,82. The grid layout selected has a total of 14 rows which are displayed in panels 78,80 and includes a hole-by-hole map above the grid at 108. The column delineations are not shown. FIG. 5 also shows panels 72,74,76 and 82 filled with representative images which denote an image placeholder selected for that panel, such as a golf course logo in panel 82, and photographic images in panels 72,74, 76. These image placeholders are electronically coded for identification purposes so that one could ultimately electronically identify and replace the representative image at the design studio stage with an actual image desired by the user.

Figure 6:
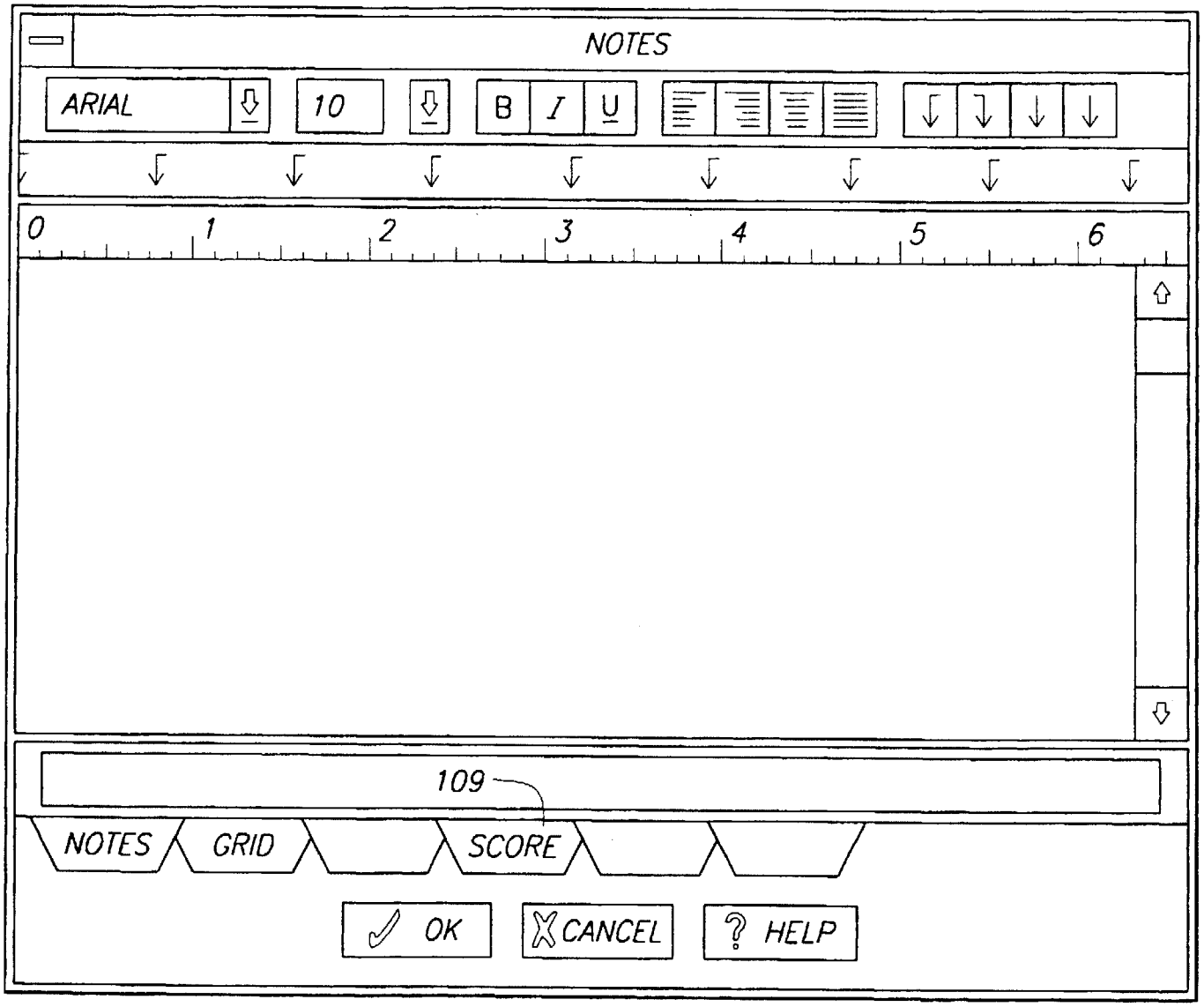
FIG. 6 is a pictorial representation of a computer display screen user interface menu in which a user can selectively view the display screens shown in FIGS. 3–9.

FIG. 6 shows the menu system embedded within the user interface for moving between data input and display pages such as those shown in FIGS. 3–9. The menu is driven via user selected tabs, such as tab 108. Selection of tab 108 causes the applications program to present the textual data input page shown in FIG. 7.

Figure 7:
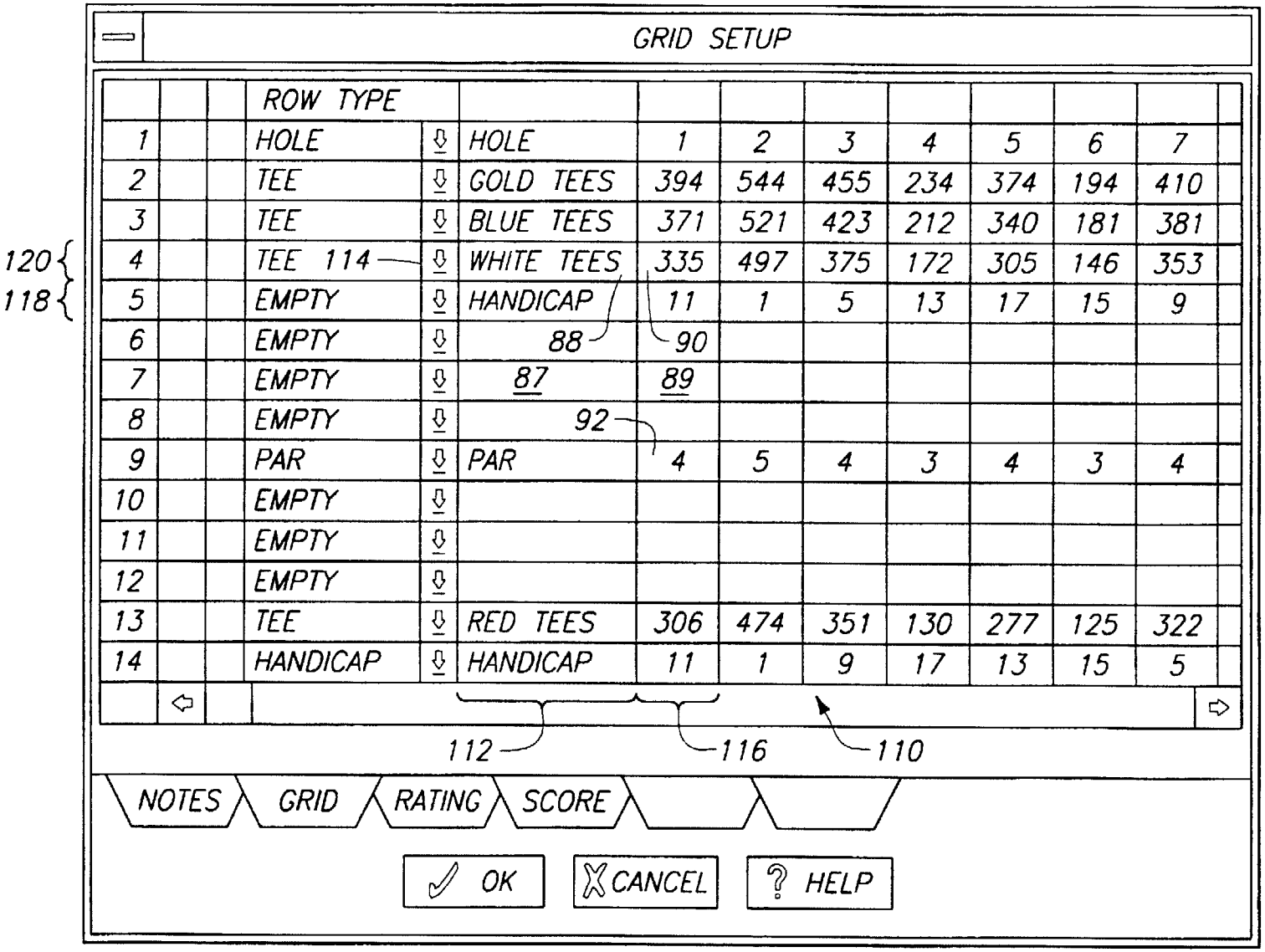
FIG. 7 illustrates an exemplary user-generated scorecard grid in which textual and numeric data are entered by a user.

FIG. 7 shows the user defined grid of the virtual score card at 110. The grid is divided into 14 rows in accordance with the criteria selected in step 42 and is divided into columns to define grid elements, such as elements 88,90,92. For instance, grid element 88 is defined within grid column 112 and contains the text "WHITE TEES" which may be accomplished by selecting the grid element and manually typing in the text and selecting pull-down button 114 which contains predefined functions, one of which being "TEE". Further columns are for each hole, such as column 116 for hole one, and for final scores (not shown). Data which is typically included within grid 110 is hole yardage, such as entered within grid element 90, and par, such as entered within grid element 92. As explained above, the data entered within the grid elements can change over the lifetime of the golf course due to hole repair or redesign. The present invention allows a simplified system of changing the data in a virtual score card, and later printing out the real score card using professional printing services or the like.

Figure 8:
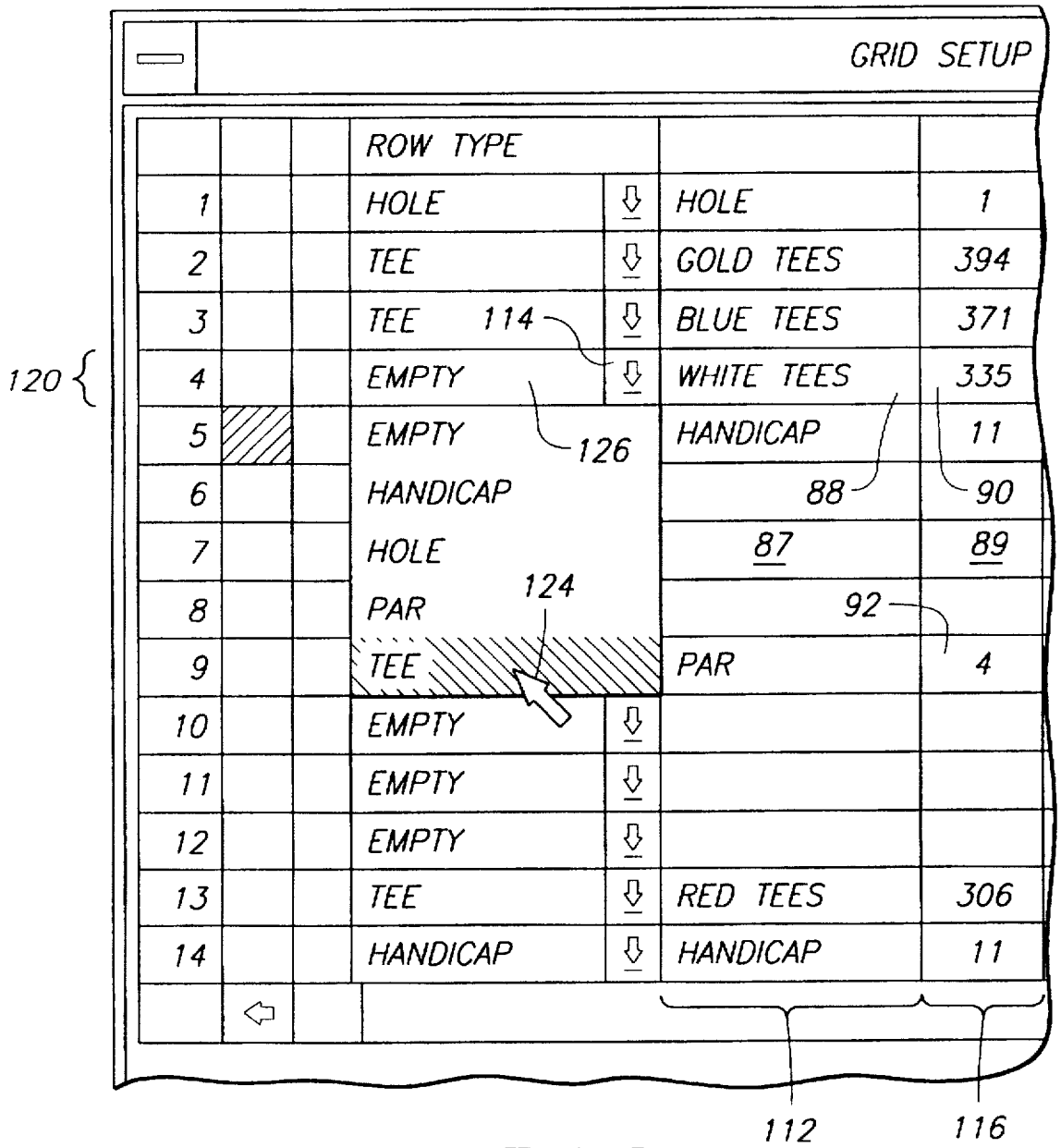
FIG. 8 shows a portion of the user-generated scorecard grid of FIG. 7 further including a pictorial representation of a pull-down menu of function options applicable to the grid row elements.

FIG. 8 shows a portion of the user-generated scorecard grid of FIG. 7 further including a pull-down menu of function options applicable to the grid row elements. Grid row elements are defined as those grid elements corresponding to a certain row, such as element 90 corresponds to row 120. Selection of pull-down button 114 opens selection panel 122 which includes function options "empty", "handicap", "hole", "par", and "tee". Each of these function options can be selected as by moving cursor or pointer 124 adjacent one of the words to thereby highlight it and clicking the mouse button.

Upon selection of the "tee" function as shown in FIG. 8, grid element 126 changes from the default function "empty" to the selected function "tee". The "tees" function allows hole yardage values to be entered in grid row elements associated with the selected function, such as in element 90. All entries are automatically added to determine a total yardage for the first nine holes, the second nine holes and the total course yardage. These values are then displayed in one or more of the grid row elements.

The "par" function works similarly to the "tee" function in that numerical data can be entered in the particular grid row elements associated with the function, such as in grid row element 92. Thereafter, all par values are added to yield a total par for the first nine holes of the golf course, the second nine holes of the golf course, and the total par for the full eighteen holes.

The "hole" function automatically numbers the grid row elements sequentially from one to eighteen, exclusive of those grid row elements in columns designated to display total par, total yards and other such columns.

The "handicap" function allows entry of numerical values in associated grid row elements corresponding to the ranked difficulty of each hole on the golf course. Adding of these entered values does not take place.

The "empty" function clears all data entered within the associated grid row elements.

Another feature of the invention is the ability to define row colors of the grid 110. As shown in FIG. 7, row 118 from the grid is selected. One of the plurality of colors from a predefined pallet of colors can be selected and assigned to the particular row. For instance, the color pallet can contain twenty predefined basic colors and a color wheel in which one of approximately 16 million other colors can be selected.

The above steps comprise the data entry subsystem of the present invention, whereby grid values for the first and second grid are entered in steps 46,48, such as yardage and par values entered within grid elements 90,92 respectively. Further, text can be entered in step 50 on the virtual score card, such as within grid element 88 of column 112 or in any selected panel of the scorecard. For instance, text describing the rules of play can be typed into the system at the Notes screen shown in FIG. 6, a panel selected, and the text inserted within that panel for display. Optionally, the grid colors can be defined in step 44 according to the method described above. For instance, the row containing data about the gold tees can be gold colored. The grid can be printed out if desired in step 52 or otherwise graphically displayed responsive to the complete digital scorecard specification.

Figure 9:
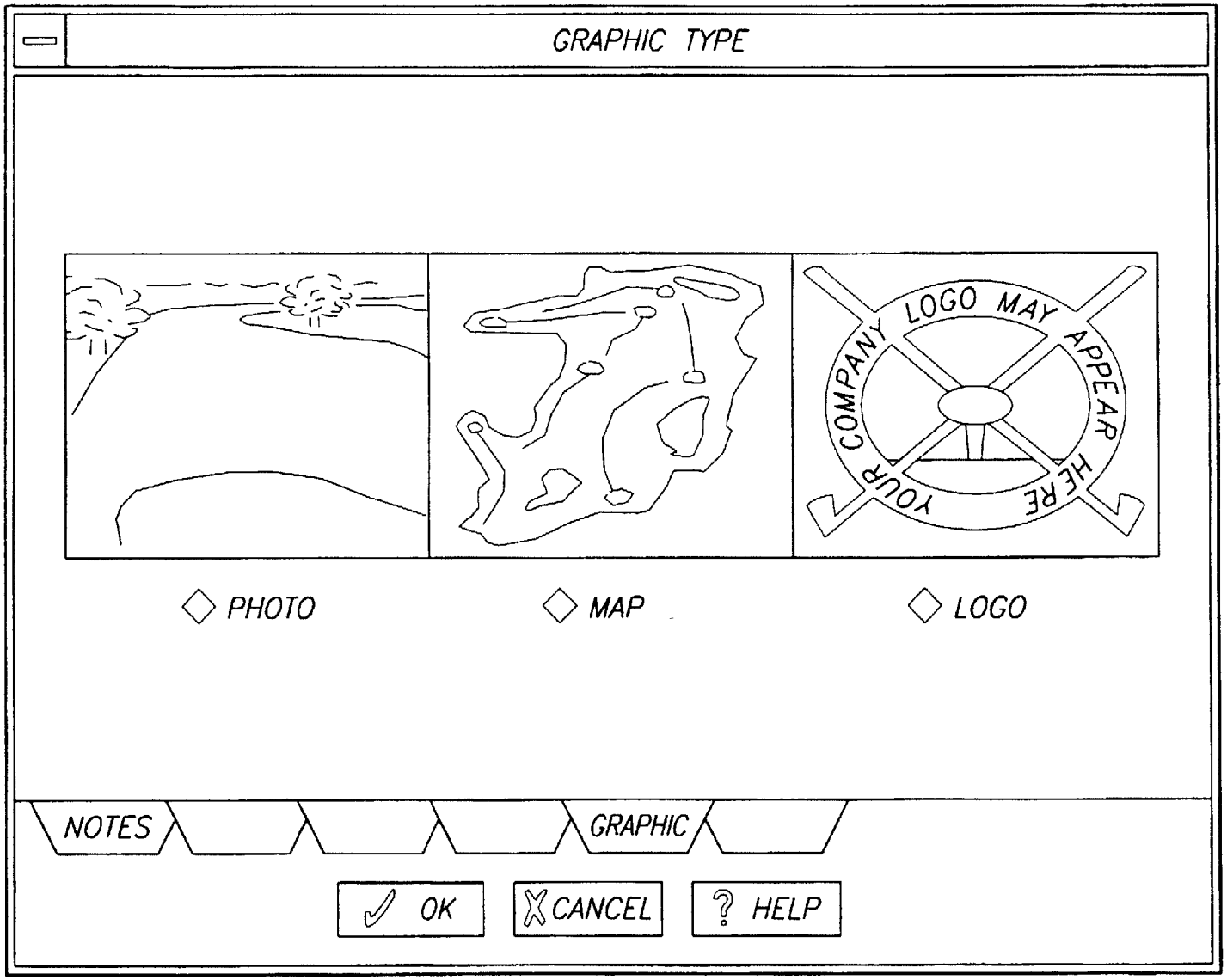
FIG. 9 shows a computer aided search means for selecting representative graphic images or placeholders for incorporation into selected panels of the golf scorecard.

FIG. 9 shows the digital library interface for use in filling the image panels, such as panels 72,74,76 and 82 of the virtual golf score card. By selecting one of the panels shown in FIG. 5 to work on, a user can select whether to associate a photograph, map or logo contained within the digital library with the panel. The representative image or placeholder can be stored in a digital library such as in memory 26 and generically associated with an image type (such as types "map", "photo" or "logo") which can be later placed within the virtual card at the digital score card design facility when the score card information is transmitted to the facility, as by magnetic media or via electronic means. Suitable electronic means can include but are not limited to the internet, a bulletin board service (BBS), telephone lines, cable lines, or satellite transmission.

Once the design is verified, as in step 52, a user can elect to design another layout, as in step 54. Otherwise, the user is given the option of displaying, printing or saving the digital scorecard specification in step 56 according to the criteria specified by the user. Once the choice for step 54 is selected, the preliminary digital golf score card specification data can be transmitted via conventional means, such as stored in a portable magnetic medium or via electronic means, to a score card design facility for incorporation within a custom score card.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A system for creating a custom golf scorecard design specification for incorporation within a custom golf scorecard comprising:

computer input means for receiving a user selection of one of a predetermined plurality of scorecard designs and user input textual data;

memory means for storing the design selection, the textual data and a file name to identify the user as a preliminary digital scorecard specification;

program means for integrating together the design selected by the user and the textual data input by the user; and display means for graphically presenting a custom golf scorecard design responsive to the preliminary digital scorecard specification.

2. A system of claim 1, further including means for transmitting the preliminary digital scorecard specification to a digital scorecard design facility.

3. A system according to claim 2 further comprising means for transmitting to the user a representation of the custom golf scorecard design specification for approval prior to final production of the custom golf scorecard.

4. A system according to claim 1, further including a set of image placeholders stored in the memory means, wherein the set of image placeholders includes a representative digital image of a golf course map.

5. A system according to claim 1, further including a set of image placeholders stored in the memory means, wherein the set of image placeholders includes a representative digital image of one or more individual holes of a user's golf course.

6. A system according to claim 1, further including a set of image placeholders stored in the memory means, wherein the set of image placeholders includes a representative digital image of a predetermined graphic logo.

7. A system according to claim 1, further including a set of image placeholders stored in the memory means, wherein the set of image placeholders includes a scanned photograph of at least a portion of a user's golf course.

8. A system according to claim 1 further including means for printing the input textual data for approval prior to final production of the custom golf scorecard.

9. A method for forming a preliminary digital scorecard specification comprising:

receiving a user-selected card format from a plurality of predetermined formats, each of said formats dividing a virtual golf score card into a specified number and arrangement of panels;

receiving a user-selected card layout, said step including receiving a user-selected number of grid rows and columns thereby forming a grid layout having a plurality of grid elements;

assigning the grid layout to at least one of the panels; and displaying a graphic representation of the card arranged according to the previous steps.

10. The method of claim 9, further including:

storing a set of image placeholders within a memory means, each of said placeholders having a representative generic image associated therewith;

receiving a user selection of one of the panels;

displaying the representative generic images associated with each of the set of image placeholders;

receiving a user selection of one of the image placeholders;

retrieving the selected placeholder from the memory means;

associating the image placeholder with the user-selected panel; and displaying the representative generic image associated with the placeholder in the user-selected panel.

11. The method of claim 9, further including:

receiving data associated with a golf course, said data selected from the group consisting of hole number, handicap, tee type, hole yardage and par value;

associating said data with at least a portion of the plurality of grid elements; and displaying said data within said associated grid elements.

12. The method of claim 11 further including:

identifying a user-selecting row of the grid;

receiving a user-selected color from a pallet of colors; and applying the color to the row.

13. The method of claim 11 wherein the grid elements associated with the grid rows are grid row elements, the method further including:

providing a plurality of user-selectable function options;

associating a user-selected one of the plurality of function options with a selected grid row; and applying the function option to the grid row elements associated with the selected grid row.

14. The method of claim 13, wherein the step of applying the function to the grid row elements associated with the selected grid row includes automatically numbering the grid row elements sequentially from one to 18.

15. The method of claim 13, wherein the step of applying the function to the grid row elements includes:

receiving from the user numerical values within the grid row elements;

automatically adding the entered numerical values to determine a total; and displaying the total in one of the grid row elements associated with the selected grid row.

16. The method of claim 13, wherein the step of applying the function to the grid row elements includes clearing the data entered within the grid row elements associated with the selected grid row.

17. The method of claim 9 further including:

receiving from the user text for display on the card;

receiving a user-selected one of the panels in which to display the text; and displaying the text associated with the selected panel.

18. The method of claim 9, further including printing out a hard copy of the text entered within the grid layout.

19. A golf score card design specification produced via the method of claim 9 comprising:

a format selected from among a plurality of pre-defined formats, said format dividing said score card into a plurality of panels; and a layout including a scoring grid associated with on one of the plurality of panels and an image selected from a digital library associated with a second panel, said scoring grid having a user-selected number of rows and columns containing pre-determined textual data supplied by the user.

20. A thumbnail graphical representation of a golf score card produced via the method of claim 9 comprising:

a format selected from among a plurality of pre-defined formats, said format dividing said score card into a plurality of panels; and a layout including a scoring grid displayed on one of the plurality of panels, said scoring grid having a user selected number of rows, said layout further including a second panel having an image placeholder associated therewith and a representative image displayed thereon.

* * * * *